US008857238B2

(12) United States Patent
Chung

(10) Patent No.: US 8,857,238 B2
(45) Date of Patent: Oct. 14, 2014

(54) METHOD FOR MANUFACTURING A QUICK RELEASE AXLE ASSEMBLY THAT HAS GREATER STRENGTH AND LIGHTER WEIGHT

(75) Inventor: Yu-Sheng Chung, Changhua (TW)

(73) Assignee: Trans-Chief Co., Ltd., Changhua (TW)

( * ) Notice: Subject to any disclaimer, the term of this patent is extended or adjusted under 35 U.S.C. 154(b) by 844 days.

(21) Appl. No.: 13/075,317

(22) Filed: Mar. 30, 2011

(65) Prior Publication Data

US 2012/0247169 A1 Oct. 4, 2012

(51) Int. Cl.

*B21D 22/00* (2006.01)
*B21D 22/02* (2006.01)
*B21D 53/88* (2006.01)

(52) U.S. Cl.

CPC ..... *B21D 22/025* (2013.01); *B21D 53/88* (2013.01)
USPC ..... 72/356; 72/341

(58) Field of Classification Search

USPC ..... 72/338, 340, 341, 356, 357, 360, 412; 301/124.2; 29/888.092
See application file for complete search history.

(56) References Cited

U.S. PATENT DOCUMENTS

| | | | | |
|---|---|---|---|---|
| 1,900,049 | A * | 3/1933 | Ellison | 411/389 |
| 2,120,118 | A * | 6/1938 | Smith | 72/356 |
| 2,815,687 | A * | 12/1957 | Spang | 72/416 |
| 4,173,501 | A * | 11/1979 | Hildebrandt et al. | 148/224 |
| 6,852,181 | B2 * | 2/2005 | Wheeler, Jr. | 148/599 |
| 7,673,947 | B2 * | 3/2010 | Chang | 301/124.2 |

FOREIGN PATENT DOCUMENTS

| | | | | |
|---|---|---|---|---|
| JP | 57-79036 A * | 5/1982 | | B21J 13/00 |

* cited by examiner

*Primary Examiner* — Edward Tolan
(74) *Attorney, Agent, or Firm* — Alan Kamrath; Kamrath IP Lawfirm, P.A.

(57) ABSTRACT

A method for manufacturing a quick release axle assembly includes preparing an elongate bar, pressing the elongate bar to form two mounting portions, at least one elongate groove and a projection, cutting the elongate bar to remove the projection from the periphery of the at least one elongate groove, and dieing the elongate bar to form a first external thread on one of the mounting portions of the elongate bar and a second external thread on the other one of the mounting portions of the elongate bar so as to produce an axle which includes the mounting portions, the at least one elongate groove, the first external thread and the second external thread. Thus, the axle is stamped and formed directly by the stamping die so that the axle is produced easily and quickly.

13 Claims, 11 Drawing Sheets

METHOD FOR MANUFACTURING A QUICK RELEASE AXLE ASSEMBLY THAT HAS GREATER STRENGTH AND LIGHTER WEIGHT

BACKGROUND OF THE INVENTION

1. Field of the Invention

The present invention relates to a method and, more particularly, to a method for manufacturing a quick release axle assembly.

2. Description of the Related Art

A conventional quick release axle assembly in accordance with the prior art shown in FIGS. 10 and 11 comprises an axle 60 and two fixing members 61 locked onto two opposite ends of the axle 60. The axle 60 has a periphery formed with a plurality of elongate grooves 62 to reduce the weight of the axle 60. In fabrication, the axle 60 is worked by turning or milling to form the elongate grooves 62. However, it takes much time to form the elongate grooves 62 on the axle 60 by turning or milling so that the axle 60 is not produced easily and quickly, thereby increasing the cost of fabrication. In addition, the rim of each of the elongate grooves 62 easily produces burs during the working process, thereby decreasing the quality of the axle 60. Further, the axle 60 is subjected to a stress concentration during the turning or milling process so that the whole strength of the axle 60 is decreased.

BRIEF SUMMARY OF THE INVENTION

In accordance with the present invention, there is provided a method for manufacturing a quick release axle assembly, comprising a first step of preparing an elongate bar, a second step of pressing the elongate bar to form two mounting portions on two opposite ends of the elongate bar, at least one elongate groove between the two mounting portions, and a projection on a periphery of the at least one elongate groove, a third step of cutting the elongate bar to remove the projection from the periphery of the at least one elongate groove of the elongate bar, and a fourth step of dieing the elongate bar to form a first external thread on one of the two mounting portions of the elongate bar and a second external thread on the other one of the two mounting portions of the elongate bar so as to produce an axle which includes the two mounting portions, the at least one elongate groove, the first external thread and the second external thread.

The primary objective of the present invention is to provide a method for manufacturing a quick release axle assembly that has greater strength and lighter weight.

According to the primary advantage of the present invention, the axle is stamped and formed integrally by the stamping die so that the axle is stressed and stiffened evenly to enhance the whole strength and stiffness of the axle.

According to another advantage of the present invention, the axle is stamped and formed directly by the stamping die so that the axle is produced easily and quickly to decrease the cost of fabrication.

According to a further advantage of the present invention, the axle is worked by a surface treatment so that the axle has a smooth and flat surface.

According to a further advantage of the present invention, the mediate portion of the axle has a flattened shape to reduce the whole weight of the axle and to decrease the cost of fabrication.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
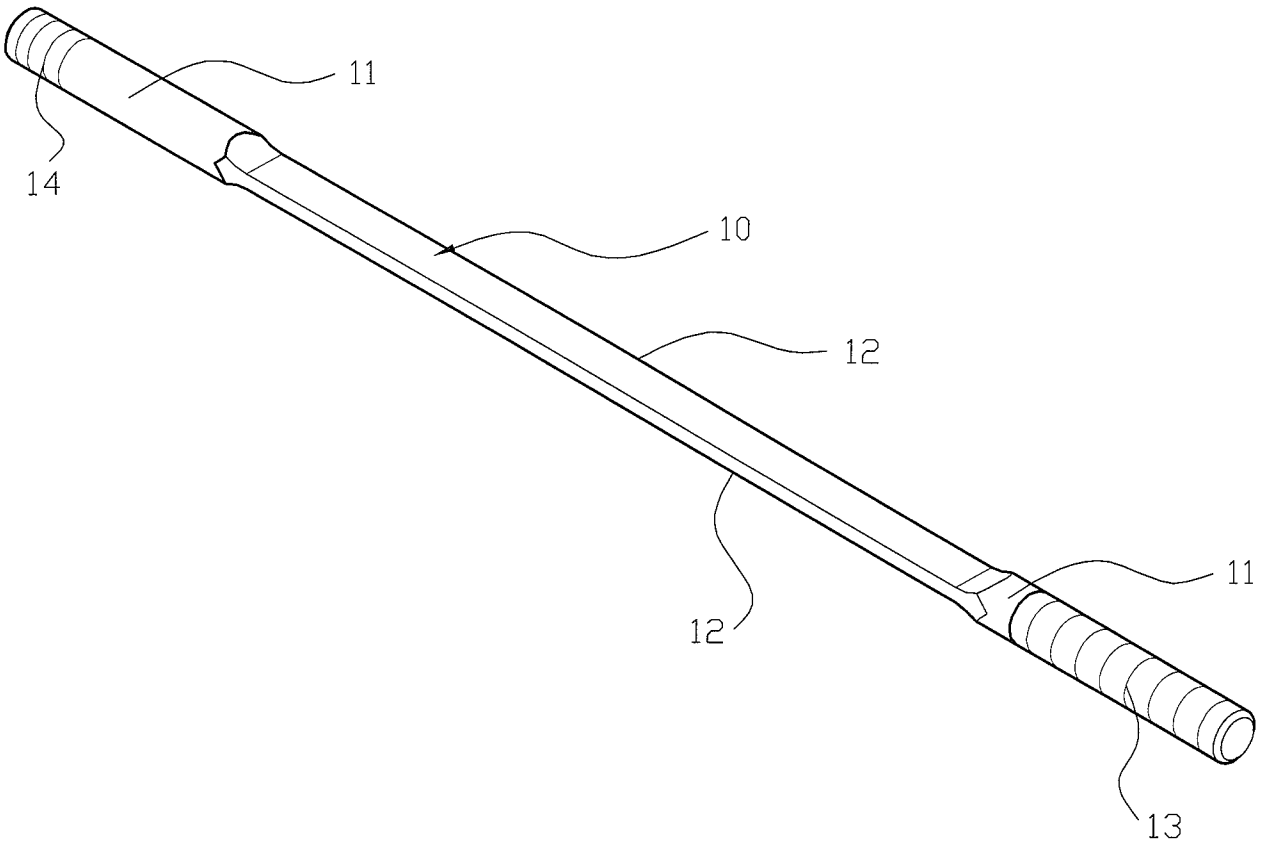
FIG. 1 is a perspective view of an axle of a quick release axle assembly in accordance with the preferred embodiment of the present invention.
Figure 2:
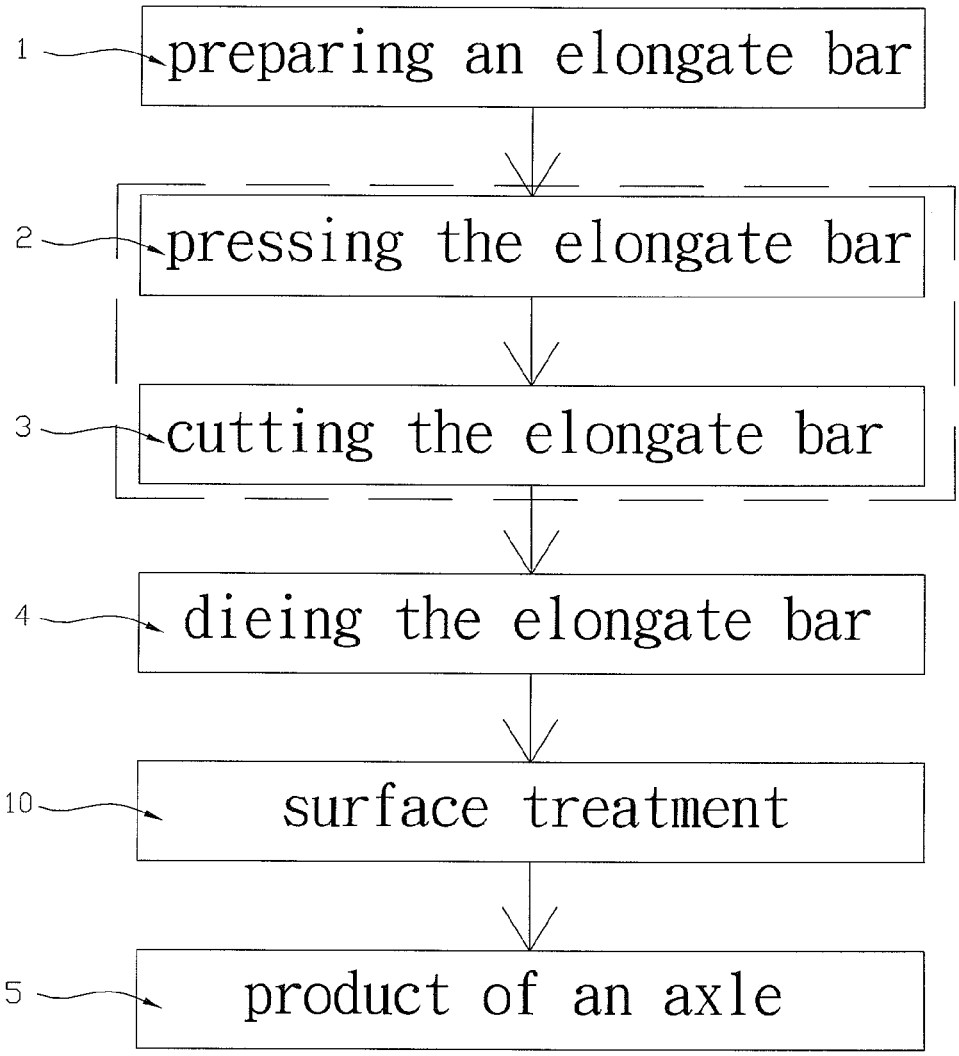
FIG. 2 is a flow chart of a method for manufacturing a quick release axle assembly in accordance with the preferred embodiment of the present invention.

Referring to the drawings and initially to FIG. 1, a quick release axle assembly in accordance with the preferred embodiment of the present invention comprises an axle 10. The axle 10 has two mounting portions 11 formed on two opposite ends thereof and has at least one elongate groove 12 formed on a mediate portion thereof. The at least one elongate groove 12 of the axle 10 is located between the two mounting portions 11. Preferably, the mediate portion of the axle 10 has a flattened shape and is formed with two opposite elongate grooves 12. One of the two mounting portions 11 of the axle 10 is provided with a first external thread 13 and the other one of the two mounting portions 11 of the axle 10 is provided with a second external thread 14. The second external thread 14 of the axle 10 has a length smaller than that of the first external thread 13.

Figure 3:
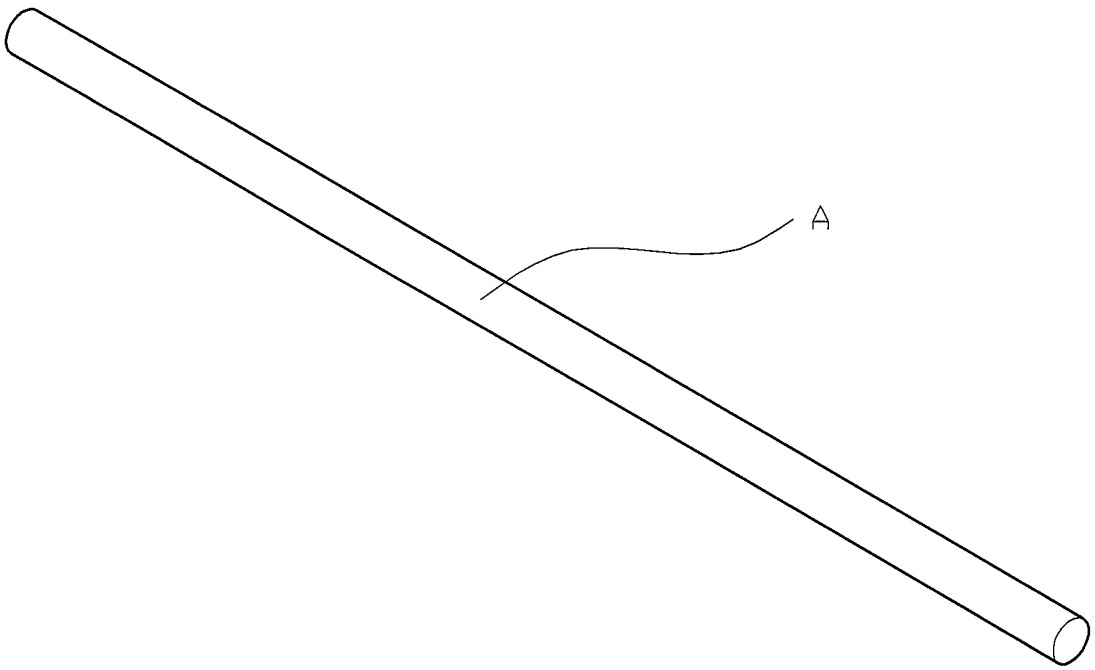
FIG. 3 is a perspective view showing an elongate bar.
Figure 4:
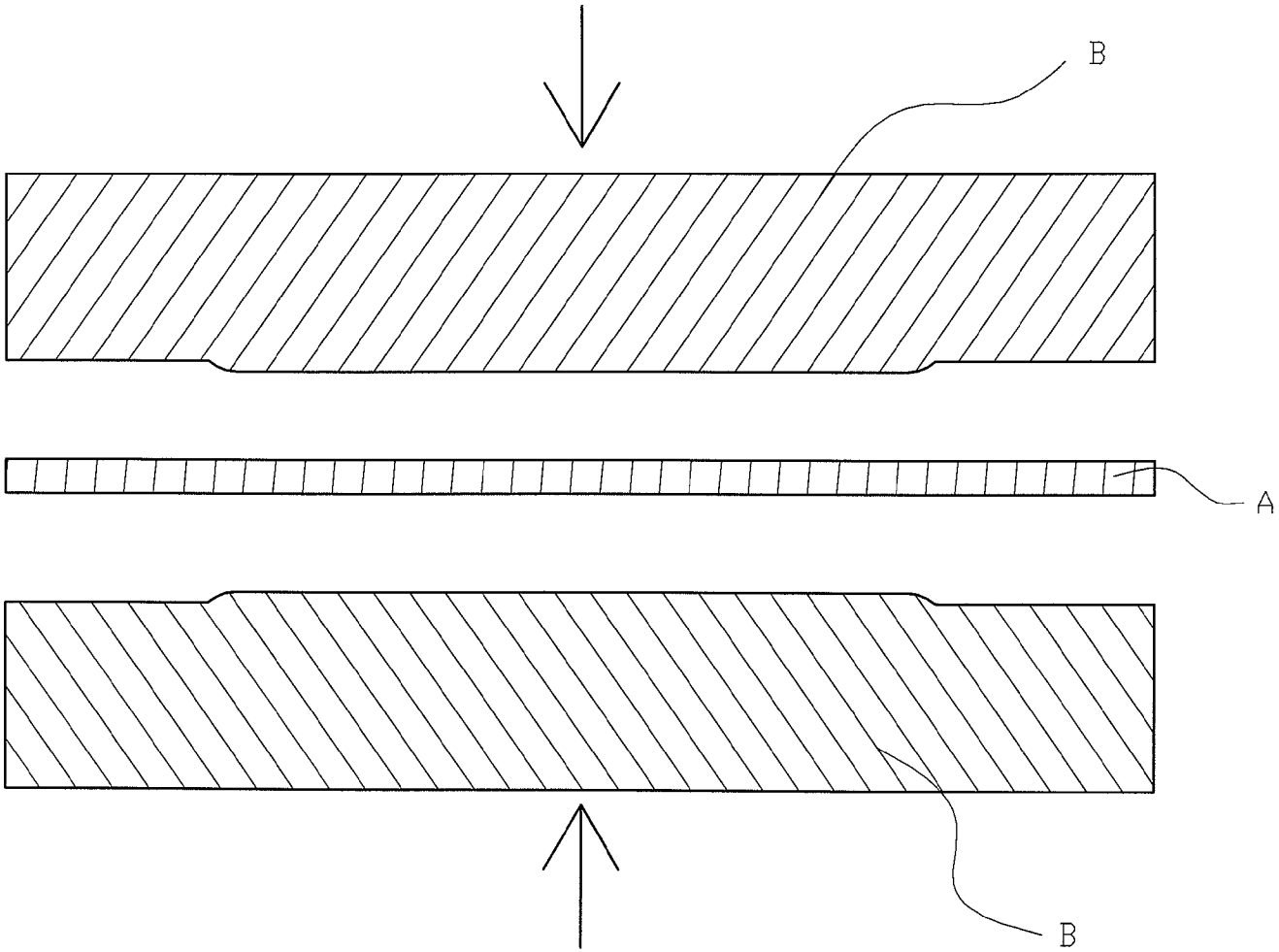
FIG. 4 is a cross-sectional view showing the elongate bar is placed into a stamping die.
Figure 5:
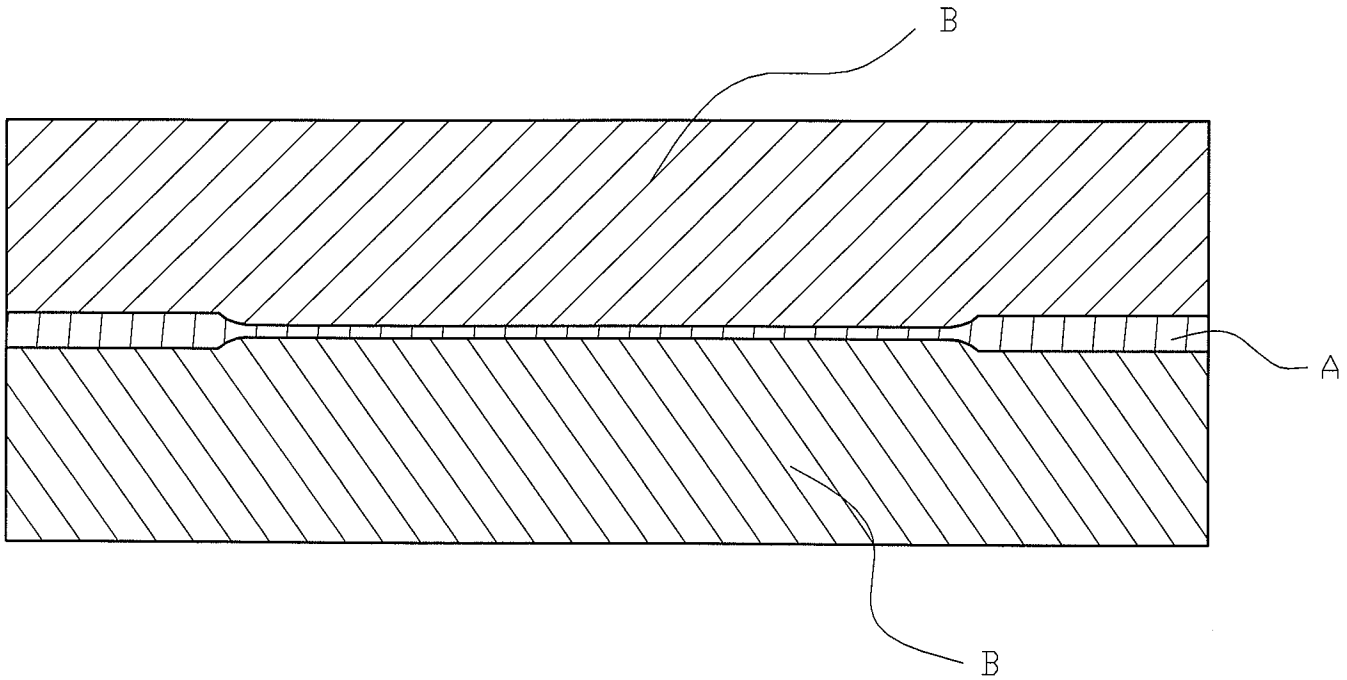
FIG. 5 is a cross-sectional view showing the elongate bar is stamped by the stamping die.
Figure 6:
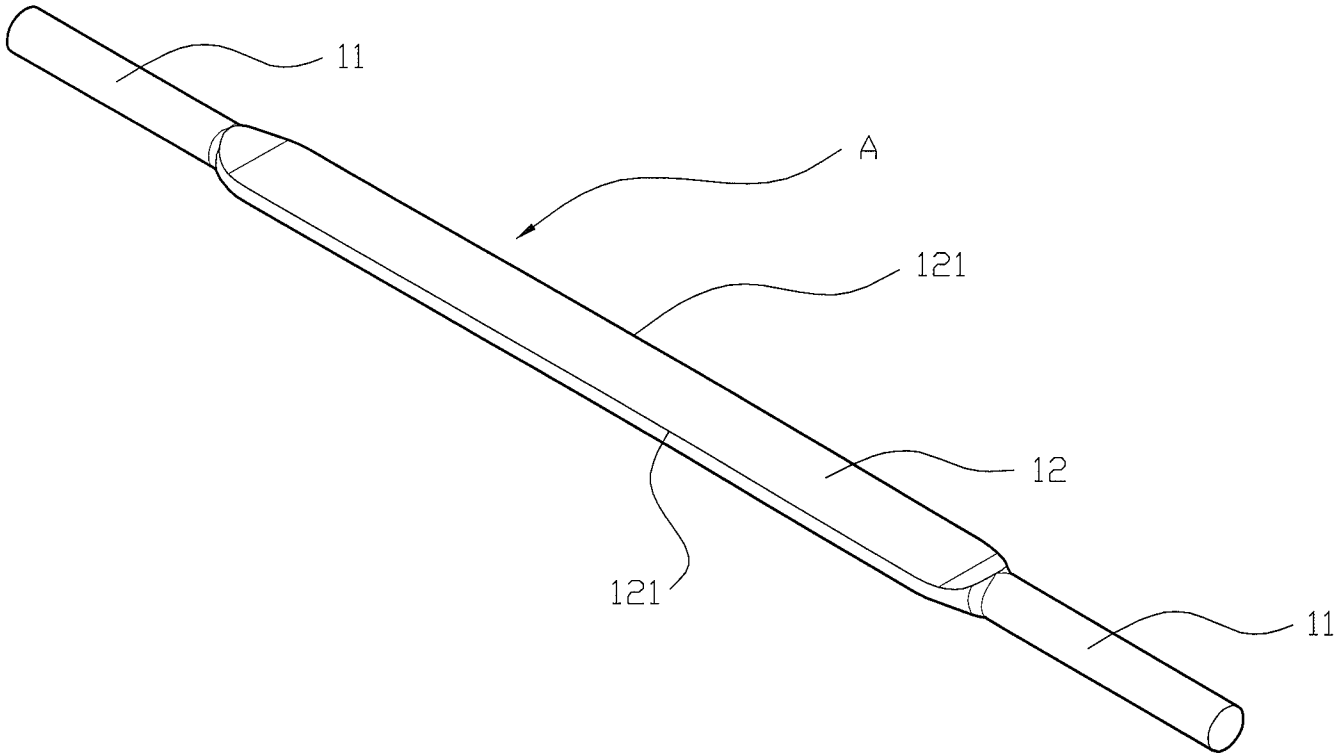
FIG. 6 is a perspective view showing the elongate bar has a projection.
Figure 7:
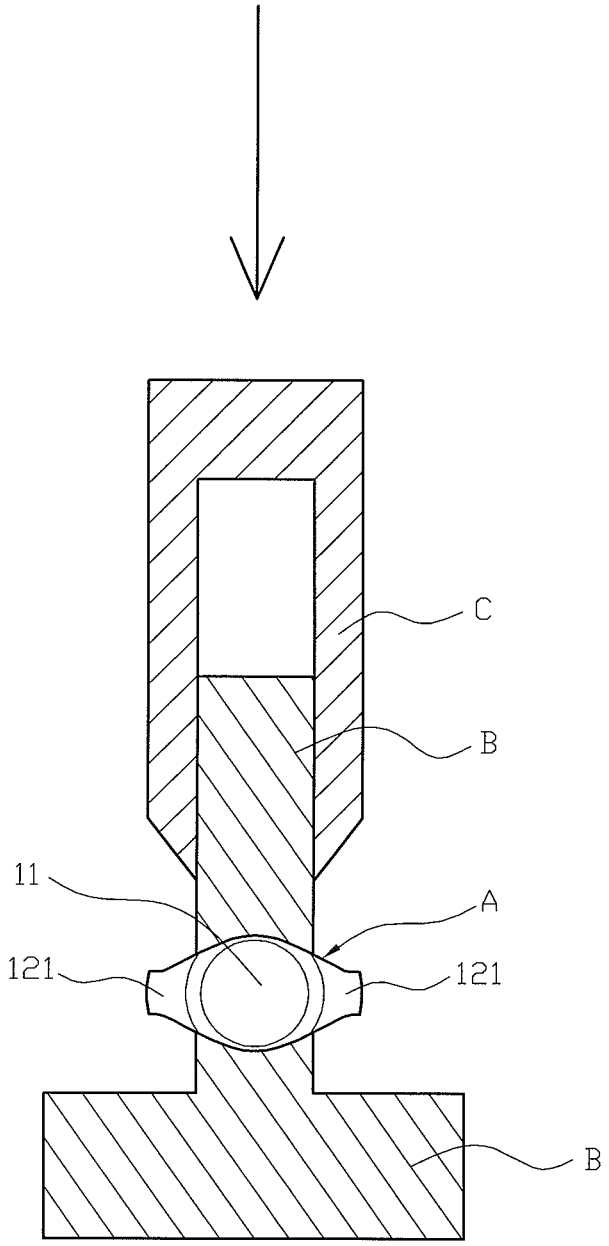
FIG. 7 is a cross-sectional view showing a stamping trimmer is placed on the stamping die and moved toward the elongate bar.
Figure 8:
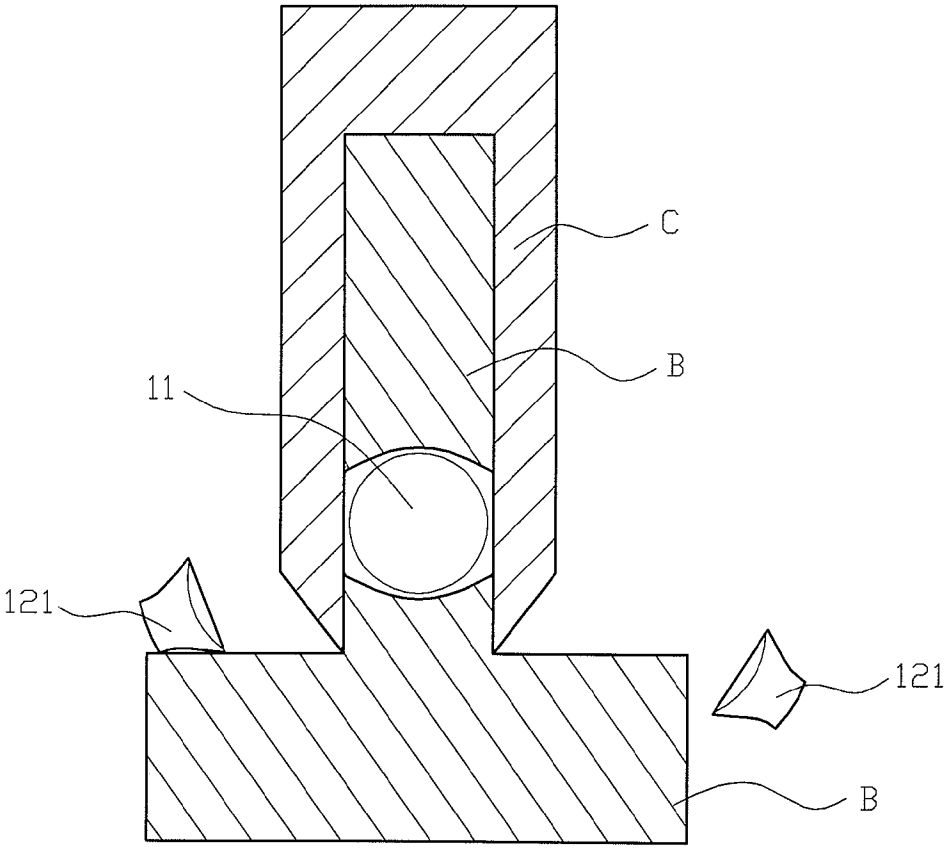
FIG. 8 is a cross-sectional view showing the projection of the elongate bar is cut by the stamping trimmer.

Referring to FIGS. 1-8, a method for manufacturing a quick release axle assembly in accordance with the preferred embodiment of the present invention comprises a first step 1 of preparing an elongate bar "A" as shown in FIG. 3, a second step 2 of pressing the elongate bar "A" to form two mounting portions 11 on two opposite ends of the elongate bar "A", at least one elongate groove 12 between the two mounting portions 11, and a projection 121 on a periphery of the at least one elongate groove 12 as shown in FIGS. 4-6, a third step 3 of cutting the elongate bar "A" to remove the projection 121 from the periphery of the at least one elongate groove 12 of the elongate bar "A" as shown in FIGS. 7 and 8, a fourth step 4 of dieing the elongate bar "A" to form a first external thread 13 on one of the two mounting portions 11 of the elongate bar "A" and a second external thread 14 on the other one of the two mounting portions 11 of the elongate bar "A" as shown in FIG. 1 so as to produce an axle 10 which includes the two mounting portions 11, the at least one elongate groove 12, the first external thread 13 and the second external thread 14.

The second step 2 of pressing the elongate bar "A" includes placing the elongate bar "A" into a stamping die "B" as shown in FIG. 4, and stamping the elongate bar "A" by the stamping die "B" as shown in FIG. 5 to form the two mounting portions 11, the at least one elongate groove 12 and the projection 121 on the elongate bar "A" simultaneously as shown in FIG. 6.

The third step 3 of cutting the elongate bar "A" includes providing a stamping trimmer "C" on the stamping die "B" as shown in FIG. 7, and moving the stamping trimmer "C" toward the elongate bar "A" to cut and remove the projection 121 from the periphery of the at least one elongate groove 12 of the elongate bar "A" as shown in FIG. 8. At this time, the at least one elongate groove 12 of the elongate bar "A" has a width smaller than a diameter of each of the two mounting portions 11 of the elongate bar "A" as shown in FIG. 1.

The fourth step 4 of dieing the elongate bar "A" includes providing a thread rolling machine on the elongate bar "A" to form the first external thread 13 and the second external thread 14 on the elongate bar "A" as shown in FIG. 1. Alternatively, the fourth step 4 of dieing the elongate bar "A" includes providing a thread cutting die on the elongate bar "A" to form the first external thread 13 and the second external thread 14 on the elongate bar "A" as shown in FIG. 1. Alternatively, the fourth step 4 of dieing the elongate bar "A" includes providing a turning tool on the elongate bar "A" to form the first external thread 13 and the second external thread 14 on the elongate bar "A" as shown in FIG. 1.

In the preferred embodiment of the present invention, the method for manufacturing a quick release axle assembly further comprises a fifth step 5 of providing a surface treatment on the axle 10 to enhance toughness and hardness of the axle 10. The fifth step 5 of providing a surface treatment on the axle 10 includes carburizing the axle 10. Alternatively, the fifth step 5 of providing a surface treatment on the axle 10 includes quenching and tempering the axle 10.

Accordingly, the axle 10 is stamped and formed integrally by the stamping die "B" so that the axle 10 is stressed and stiffened evenly to enhance the whole strength and stiffness of the axle 10. In addition, the axle 10 is stamped and formed directly by the stamping die "B" so that the axle 10 is produced easily and quickly to decrease the cost of fabrication. Further, the axle 10 is worked by a surface treatment so that the axle 10 has a smooth and flat surface. Further, the mediate portion of the axle 10 has a flattened shape to reduce the whole weight of the axle 10 and to decrease the cost of fabrication.

Figure 9:
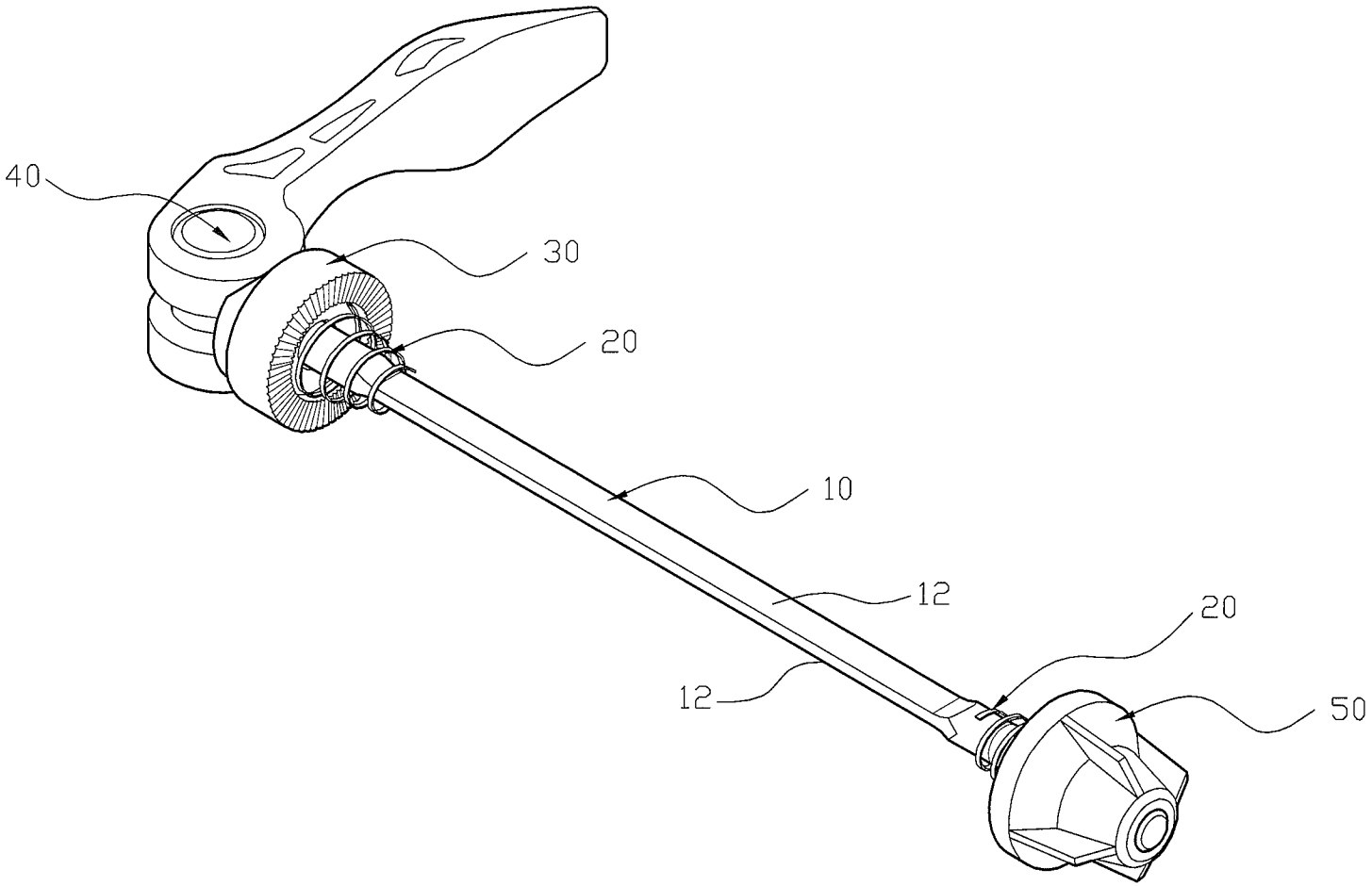
FIG. 9 is a perspective view of a quick release axle assembly in accordance with the preferred embodiment of the present invention.
Figure 10:
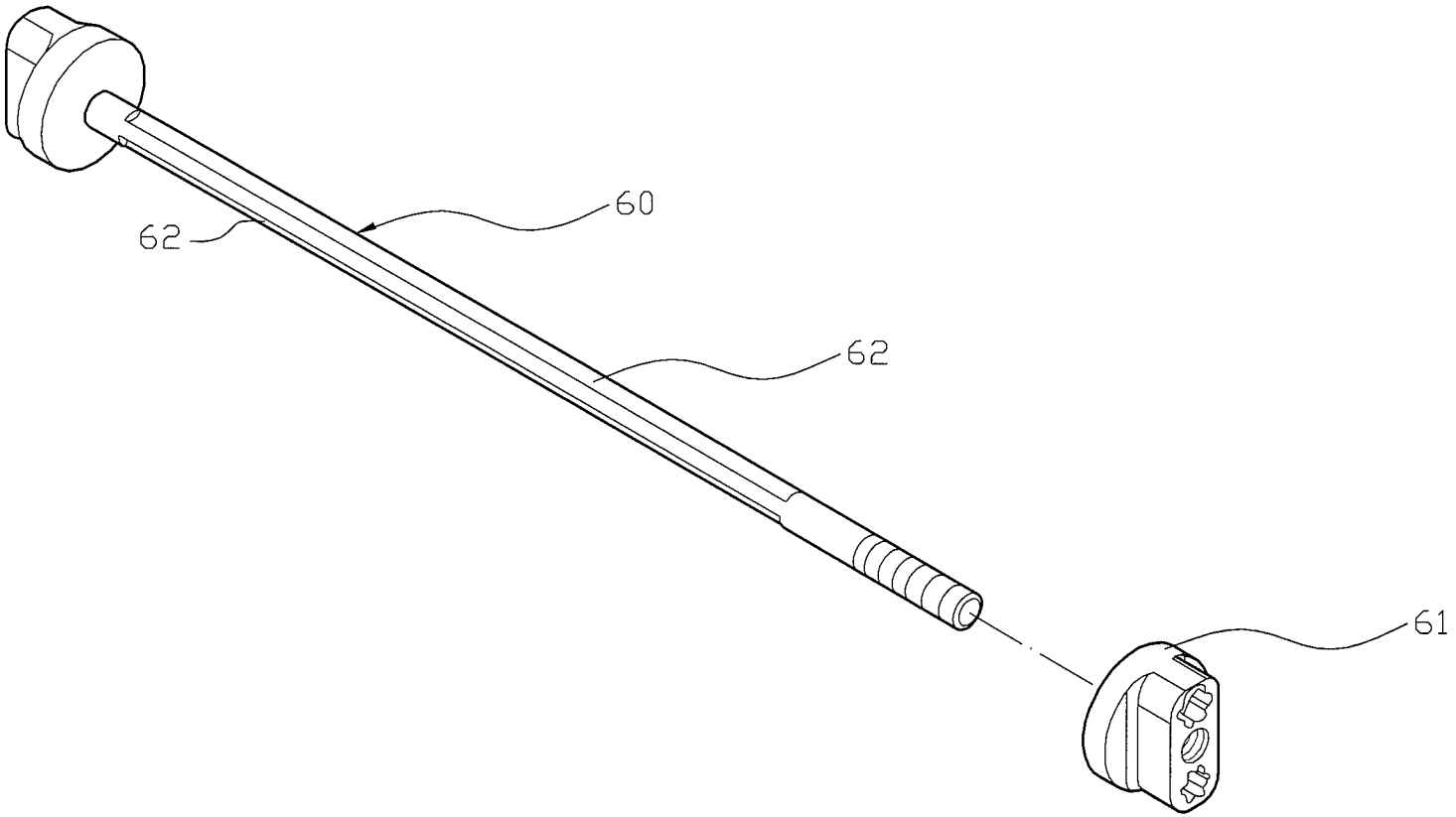
FIG. 10 PRIOR ART
FIG. 10 is a partially exploded perspective view of a conventional quick release axle assembly in accordance with the prior art.
Figure 11:
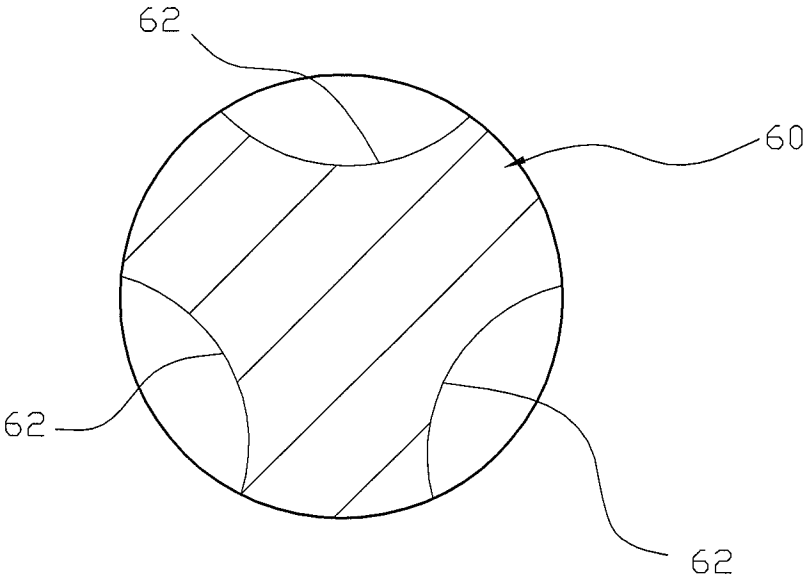
FIG. 11 PRIOR ART
FIG. 11 is a side cross-sectional view of the conventional quick release axle assembly as shown in FIG. 10.

Referring to FIG. 9 with reference to FIG. 1, the quick release axle assembly further comprises two elastic members 20 mounted on the two mounting portions 11 of the axle 10 respectively, a fixing member 50 locked onto the first external thread 13 of the axle 10 and abutting one of the two elastic members 20, a quick release device 40 locked onto the second external thread 14 of the axle 10, and a pressing member 30 mounted the second external thread 14 of the axle 10 and biased between the quick release device 40 and the other one of the two elastic members 20.

Thus, the method for manufacturing a quick release axle assembly further comprises a sixth step of providing two elastic members 20 on the two mounting portions 11 of the axle 10 respectively, a seventh step of providing a fixing member 50 which is locked onto the first external thread 13 of the axle 10 and abuts one of the two elastic members 20, a eighth step of providing a quick release device 40 which is locked onto the second external thread 14 of the axle 10, and a ninth step of providing a pressing member 30 which is mounted the second external thread 14 of the axle 10 and biased between the quick release device 40 and the other one of the two elastic members 20.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A method for manufacturing a quick release axle assembly, comprising:

a first step of preparing an elongate bar having a circular shape;

a second step of pressing the elongate bar to form two mounting portions on two opposite ends of the elongate bar, at least one elongate groove between the two mounting portions, and a projection on a periphery of the at least one elongate groove;

a third step of cutting the elongate bar to remove the projection from the periphery of the at least one elongate groove of the elongate bar;

a fourth step of dieing the elongate bar to form a first external thread on one of the two mounting portions of the elongate bar and a second external thread on the other one of the two mounting portions of the elongate bar so as to produce an axle which includes the two mounting portions, the at least one elongate groove, the first external thread and the second external thread;

a fifth step of providing a surface treatment on the axle to enhance toughness and hardness of the axle;

a sixth step of providing two elastic members on the two mounting portions of the axle respectively;

a seventh step of providing a fixing member which is locked onto the first external thread of the axle and abuts one of the two elastic members;

a eighth step of providing a quick release device which is locked onto the second external thread of the axle; and a ninth step of providing a pressing member which is mounted the second external thread of the axle and biased between the quick release device and the other one of the two elastic members.

2. The method for manufacturing a quick release axle assembly of claim 1, wherein the second step of pressing the elongate bar includes:

placing the elongate bar into a stamping die; and stamping the elongate bar by the stamping die to form the two mounting portions, the at least one elongate groove and the projection on the elongate bar simultaneously.

3. The method for manufacturing a quick release axle assembly of claim 1, wherein the third step of cutting the elongate bar includes:

providing a stamping trimmer on the stamping die; and moving the stamping trimmer toward the elongate bar to cut and remove the projection from the periphery of the at least one elongate groove of the elongate bar.

4. The method for manufacturing a quick release axle assembly of claim 1, wherein the at least one elongate groove of the elongate bar has a width smaller than a diameter of each of the two mounting portions of the elongate bar.

5. The method for manufacturing a quick release axle assembly of claim 1, wherein the fourth step of dieing the elongate bar includes:

providing a thread rolling machine on the elongate bar to form the first external thread and the second external thread on the elongate bar.

6. The method for manufacturing a quick release axle assembly of claim 1, wherein the fourth step of dieing the elongate bar includes:

providing a thread cutting die on the elongate bar to form the first external thread and the second external thread on the elongate bar.

7. The method for manufacturing a quick release axle assembly of claim 1, wherein the fourth step of dieing the elongate bar includes:

providing a turning tool on the elongate bar to form the first external thread and the second external thread on the elongate bar.

8. The method for manufacturing a quick release axle assembly of claim 1, wherein the fifth step of providing a surface treatment on the axle includes:

carburizing the axle.

9. The method for manufacturing a quick release axle assembly of claim 1, wherein the fifth step of providing a surface treatment on the axle includes:

quenching and tempering the axle.

10. The method for manufacturing a quick release axle assembly of claim 1, wherein the at least one elongate groove of the axle is formed on a mediate portion of the axle.

11. The method for manufacturing a quick release axle assembly of claim 10, wherein the mediate portion of the axle has a flattened shape.

12. The method for manufacturing a quick release axle assembly of claim 10, wherein the mediate portion of the axle is formed with two opposite elongate grooves.

13. The method for manufacturing a quick release axle assembly of claim 1, wherein the second external thread of the axle has a length smaller than that of the first external thread.

* * * * *